US007746000B2

(12) United States Patent
Takagaki et al.

(10) Patent No.: US 7,746,000 B2
(45) Date of Patent: Jun. 29, 2010

(54) DISCHARGE BULB

(75) Inventors: Michio Takagaki, Shizuoka (JP); Akira Homma, Shizuoka (JP); Takeshi Fukuyo, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 213 days.

(21) Appl. No.: 12/021,653

(22) Filed: Jan. 29, 2008

(65) Prior Publication Data

US 2008/0203919 A1 Aug. 28, 2008

(30) Foreign Application Priority Data

Feb. 22, 2007 (JP) ..... 2007-042027

(51) Int. Cl.
*H01J 17/04* (2006.01)

(52) U.S. Cl. ..... 313/633; 313/491

(58) Field of Classification Search ..... 313/491, 313/633

See application file for complete search history.

(56) References Cited

U.S. PATENT DOCUMENTS 2,965,790 A * 12/1960 Ittig et al. ..... 313/570
4,672,267 A * 6/1987 Lapatovich et al. ..... 313/571
4,992,703 A * 2/1991 Ramaiah ..... 315/261

FOREIGN PATENT DOCUMENTS

JP 2005-183165 A 7/2005

* cited by examiner

*Primary Examiner*—Vip Patel
(74) *Attorney, Agent, or Firm*—Sughrue Mion, PLLC

(57) ABSTRACT

A discharge bulb is provided. The discharge bulb includes an arc tube, a glass shroud cylindrically surrounding the arc tube, and an insulated plug fixedly supporting an end portion of the glass shroud. The arc tube includes a light generating portion having a discharge space therein, a first pinch seal portion and a second pinch seal portion disposed on respective sides of the light generating portion, a first electrode rod protruding into the discharge space from the first pinch seal portion, and a second electrode rod protruding into the discharge space from the second pinch seal portion so as to be opposed to the first electrode rod. The discharge space contains a rare gas and a metal halide, but does not contain mercury. The first electrode is made of thoriated tungsten, and the second electrode rod is made of pure tungsten.

14 Claims, 4 Drawing Sheets

FIG. 3

| | EXEMPLARY EMBODIMENT | COMPARATIVE EXAMPLE 1 | COMPARATIVE EXAMPLE 2 |
|---|---|---|---|
| CONFIGURATION AND MATERIAL OF ELECTRODES | PURE TUNGSTEN 26B 26A THORIATED TUNGSTEN | THORIATED TUNGSTEN THORIATED TUNGSTEN | PURE TUNGSTEN PURE TUNGSTEN |
| LIFE (hr) | 2655 (n = 10) | 2134 (n = 10) | 2710 (n = 10) |
| LUMINOUS FLUX (lm) | 3208 (n = 20) | 3242 (n = 20) | 3017 (n = 20) |
| NOISE (dBm) | -84.0 (n = 20) | -86.3 (n = 20) | -73.5 (n = 20) |

DISCHARGE BULB

FIELD OF THE INVENTION

Apparatuses consistent with the present invention relate to lamps, and more particularly, to a discharge bulb adapted to be used as a light source of a vehicle lamp.

DESCRIPTION OF THE RELATED ART

Related art discharge bulbs include a silica glass arc tube having a light generating portion, a glass shroud cylindrically surrounding the arc tube, and an insulated plug fixedly supporting a rear end portion of the glass shroud.

The arc tube has pinch seal portions on front and rear sides of the light generating portion respectively, and a pair of electrode rods partially disposed inside the respective pinch seal portions. The electrode rods are typically made of thoriated tungsten. Distal end portions of the electrode rods protrude into a discharge space inside the light generating portion so as to face each other.

In order to improve luminous efficiency, mercury may be added into the discharge space of the light generating portion together with a rare gas and a metal halide. However, mercury is an environmentally harmful substance. Thus, there arc increasing pressures in recent years to reduce the use of mercury in products. Accordingly, Japanese Patent Application JP2005-183165A, for example, has proposed a mercury-free discharge bulb in which the discharge space of the light generating portion is filled with a metal halide and a rare gas without mercury being added thereto.

However, removing the mercury from the discharge bulb to produce a mercury-free discharge bulb creates some disadvantages. A tube voltage of the mercury-free discharge bulb is smaller than that of the mercury-added discharge bulb. Therefore, it is more difficult, in the mercury-free discharge bulb, to gain a tube electric power for a discharge. A tube current may be increased to compensate for the reduction of tube voltage. However, in such a case, an electrode load increases so that a temperature of the electrode rods increases, and therefore the electrode rods more easily melt. Accordingly, to adjust for the increased electrode load, the diameters of the electrode rods may be increased for the mercury-free discharge bulb.

The larger diameters of the electrode rods contribute to reducing a generation of flickers (i.e., a visual sensation produced by fluctuations in light) to some extent. However, flickers still tend to be generated in an early stage in the mercury-free discharge bulb when compared with the mercury-added discharge bulb.

In order to address the problem of the flickers, the electrode rods of the mercury-free discharge bulb may be made with pure tungsten instead of thoriated tungsten, which is used as a material for the electrode rods in the mercury-added discharge bulb. However, in a case where pure tungsten is used for the electrode rods of the mercury-free discharge bulb, luminous flux decreases and in addition, a noise becomes more likely to be generated when turning on the discharge bulb.

SUMMARY OF THE INVENTION

It is an aspect of the present invention to provide a discharge bulb in which an early generation of flickers and a generation of initial noise are reduced and in which a luminous flux is maintained at a high level, even when the discharge bulb is a mercury-free discharge bulb.

According to an aspect of the invention, a discharge bulb includes an arc tube, a glass shroud cylindrically surrounding the arc tube, and an insulated plug fixedly supporting an end portion of the glass shroud. The arc tube includes a light generating portion having a discharge space therein, a first pinch seal portion and a second pinch seal portion disposed on respective sides of the light generating portion, a first electrode rod protruding into the discharge space from the first pinch seal portion, and a second electrode rod protruding into the discharge space from the second pinch seal portion so as to be opposed to the first electrode rod. The discharge space contains a rare gas and a metal halide, but does not contain mercury. The first electrode is made of thoriated tungsten, and the second electrode rod is made of pure tungsten.

The "pure tungsten" denotes a tungsten whose tungsten purity is about 99.95% or more. However, a composition of an impurity contained in the remaining proportion of about 0.05% is not particularly restricted.

The "thoriated tungsten" denotes a tungsten in which thorium oxide is dispersed in pure tungsten.

Other aspects and advantages of the invention will be apparent from the following description, the drawings and the claims.

BRIEF DESCRIPTION OF THE DRAWINGS

FIG. 3 is a diagram showing a result of an experiment for verifying bulb performance of the discharge bulb according to the exemplary embodiment in comparison with a comparative example 1 and a comparative example 2.

DESCRIPTION OF EXEMPLARY EMBODIMENT OF THE PRESENT INVENTION

Hereinafter, an exemplary embodiment of the present invention will be explained with reference to the drawings. The following exemplary embodiment does not limit the scope of the present invention.

Figure 1:
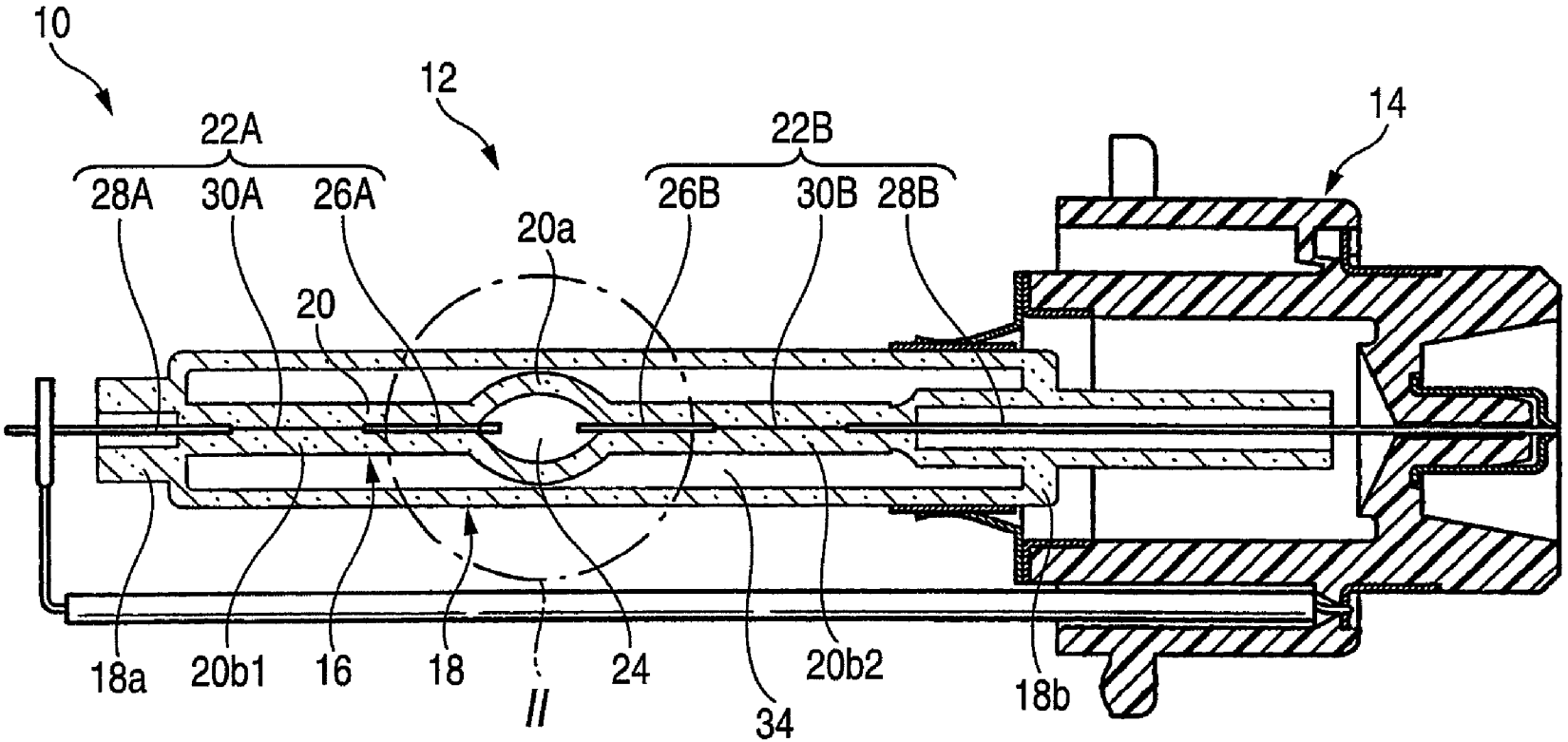
FIG. 1 is a side sectional view of a discharge bulb according to an exemplary embodiment of the invention.

FIG. 1 shows a discharge bulb 10 according to an exemplary embodiment of the present invention. The discharge bulb 10 may be used as a light source of a vehicle lamp such as a headlamp. However, one of ordinary skill in the art will appreciate that the discharge bulb according to an exemplary embodiment of the present invention may be used as a light source in any lamp in which it is advantageous to have a mercury-free discharge bulb in which an early generation of flickers and a generation of initial noise are reduced while maintaining a luminous flux at a high level.

If a discharge bulb is illuminated with a direct current, metallic ions are unevenly distributed, i.e., the metallic ions are gathered around a cathode. As a result, an area around the cathode becomes brighter than an area around an anode. Therefore, if such a discharge bulb is used as a light source of a lamp, color irregularities are created in a light distribution pattern formed by a light irradiated from the lamp. Accordingly, the discharge bulb 10 is illuminated with an alternating current, thereby preventing the uneven distribution of the metallic ions.

As shown in FIG. 1, the discharge bulb 10 includes an arc tube unit 12 extending in a front-and-rear direction and an insulated plug 14 fixedly supporting a rear end portion of the arc tube unit 12.

The arc tube unit 12 includes an arc tube 16 and a glass shroud 18 cylindrically surrounding the arc tube 16. The arc tube 16 and the glass shroud 18 may be formed in a one-piece structure.

The arc tube 16 includes an arc tube body 20 and a front electrode assembly 22A and a rear electrode assembly 22B embedded inside the arc tube body 20. The arc tube body is formed by processing a silica glass tube having a thin cylindrical shape.

The arc tube body 20 includes a light generating portion 20*a* at a center portion thereof and pinch seal portions 20*b*1, 20*b*2 on front and rear sides, respectively, of the light generating portion 20*a*. The light generating portion 20*a* has an oval spherical shape, and a discharge space 24 is provided therein. The discharge space 24 has an oval spherical shape extending in the front-and-rear direction.

Each of the electrode assemblies 22A, 22B includes an electrode rod 26A, 26B made of tungsten, a lead wire 28A, 28B made of molybdenum, and a metallic foil 30A, 30B made of molybdenum. The electrode rod 26A, 26B and the lead wire 28A, 28B is fixedly connected via the metallic foil 30A, 30B. The electrode assemblies 22A, 22B are pinch-sealed at the pinch seal portions 20*b*1, 20*b*2, respectively.

The metallic foils 30A, 30B are entirely embedded within the pinch seal portions 20*b*1, 20*b*2. Distal end portions of the electrode rods 26A, 26B, respectively, protrude into the discharge space 24 so as to oppose each other from the front and rear sides, respectively. When the discharge bulb is turned on, an arc-shaped discharge light emitting portion 32 (see FIG. 2) is formed between the distal end portions of the electrode rods 26A, 26B.

In a manufacturing process of this arc tube 16, a first pinch sealing is carried out on the pinch seal portion 20*b*2, which is on the rear side of the light generating portion 20*a*, and a second pinch sealing is carried out on the pinch seal portion 20*b*1, which is on the front side of the light generating portion 20*a*.

The electrode rod 26B (a first electrode rod) on the rear side of the light generating portion 20*a* is made of thoriated tungsten, while the electrode rod 26A (a second electrode rod) on the front side of the light generating portion 20*a* is made of pure tungsten.

The "pure tungsten" denotes a tungsten whose tungsten purity is about 99.95% or more. A composition of an impurity contained in the remaining proportion of about 0.05% is not restricted.

The "thoriated tungsten" denotes a tungsten in which thorium oxide is dispersed in pure tungsten.

For example, the pure tungsten may be a potassium doped tungsten in which a minute amount (about 100 ppm or less) of potassium is doped in tungsten. The thoriated tungsten may be a tungsten in which thorium oxide is dispersed with a proportion of about 0.8% to about 1.2%.

Figure 2:
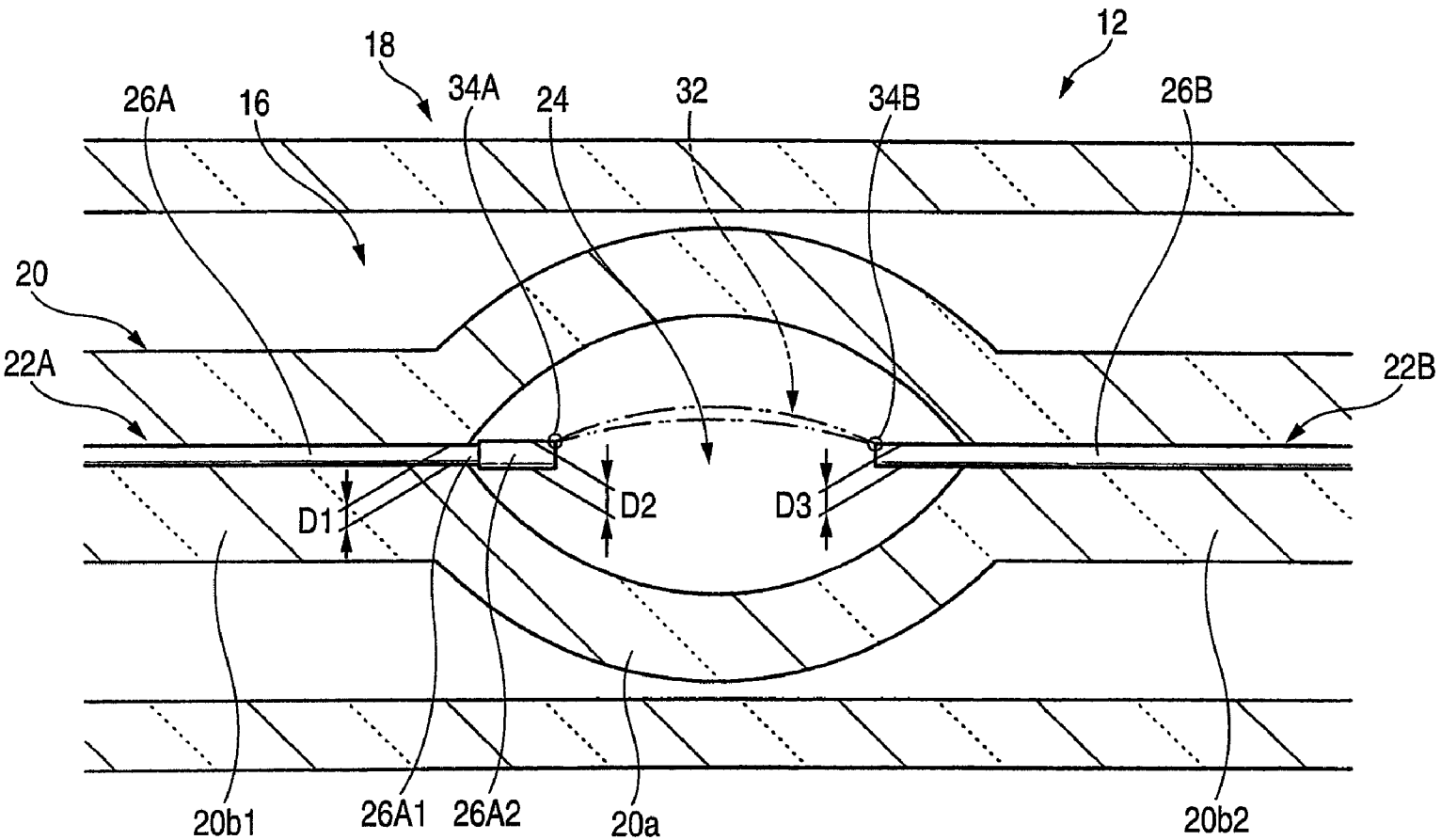
FIG. 2 is a detailed view of a portion II shown in FIG. 1.

As shown in FIG. 2, a portion of the electrode rod 26A exposed into the discharge space 24 includes a base portion 26A1 having a constant diameter D1 and a large-diameter portion 26A2 having a larger diameter D2 than the base portion 26A1. The large-diameter portion 26A2 is disposed on a distal end side of the base portion 26A1. On the other hand, a portion of the electrode rod 26B exposed into the discharge space 24 is formed to have a constant diameter D3.

The diameter D1 of the base portion 26A1 of the electrode rod 26A is smaller than the diameter D3 of the electrode rod 26B (more precisely, smaller than the diameter D3 of the portion of the electrode rod 26B exposed into the discharge space 24). The diameter D2 of the large-diameter portion 26A2 of the electrode rod 26A is larger than the diameter D3 of the electrode rod 26B. For example, the respective diameters may be set such that D1=about 0.30 mm, D2=about 0.39 mm, D3=about 0.32 mm. A length of the large-diameter portion 26A2 of the electrode rod 26A may be from about 1 mm to about 2 mm.

The discharge bulb 10 according to the exemplary embodiment of the present invention is configured as a mercury-free discharge bulb. Namely, the discharge space 24 is filled with a rare gas and a metal halide, but mercury is not added thereto.

The rare gas facilitates a generation of discharge between the distal end portions of the electrode rods 26A, 26B. Xenon gas may, for example, be used. The metal halide enhances the luminous efficiency and the color rendering properties. Sodium iodide and scandium iodide, for example, may be used.

Mercury has a buffering function of mitigating a damage to the electrode rods 26A, 26B by decreasing the amount of electrons colliding against the electrode rods 26A, 26B. However, because the discharge bulb 10 is free from mercury, the buffering function of the mercury cannot be obtained. As a substance which substitutes for mercury to obtain the buffering function, a buffering metal halide is added in the discharge space 24. The buffering metal halide may be one or any combination of halides of Zn, In, and Sb.

A cylindrical space between the between the arc tube 16 and the glass shroud 18 is filled with, e.g., a rare gas such as argon gas or xenon gas, a single gas such as nitrogen, oxygen and carbon dioxide or a mixture gas containing a plurality of kinds of gases. A filling pressure of the gas inside the cylindrical space is set to a negative pressure of about 0.01 MPa to about 0.09 MPa.

When sealing the glass shroud 18 to the arc tube 16, a rear end portion 18*b* of the glass shroud 18 is firstly welded to the arc tube 16 (see FIG. 1). Thereafter, the cylindrical space is filled with the gas, and then, a front end portion 18*a* of the glass shroud 18 is welded to the arc tube 16.

Next, functions and advantages of the exemplary embodiment will be described.

The discharge bulb 10 according to the exemplary embodiment is configured as a mercury-free discharge bulb. However, because the first electrode rod 26B is made of thoriated tungsten and the second electrode rod 26A is made of pure tungsten, a generation of flickers in an early stage can be restrained compared to a case where both of the electrode rods are made of thoriated tungsten.

The reasons are as follows.

In a mercury-free discharge bulb like the discharge bulb 10, a tube voltage decreases compared to a mercury-added discharge bulb. Thus, it is difficult to obtain a tube electric power for a discharge. When a tube current is increased to compensate for the decrease in tube voltage, however, a load to the electrodes increases. Accordingly, diameters of the electrode rods need to be increased.

The large diameters of the electrode rods contribute to preventing a generation of flickers to some extent. However, the discharge bulb 10 according to the exemplary embodiment is illuminated with an alternating current to prevent the uneven distribution of metal ions. Therefore, even if the diameters of the electrode rods 26A, 26B are made large, there still remains the problem that the flickers are likely to be generated in the early stage. Namely, the alternating current illumination utilizes a rectangular wave. When a polarity of the rectangular wave is switched, the tube current becomes zero momentarily so that a restriking voltage is used to cause the tube current to flow again. However, when the tube voltage rises due to the illumination over a long time, the restriking voltage also rises. When the restriking voltage rises so high that it exceeds a lighting capability of a ballast (i.e., a lighting circuit unit for illuminating the discharge bulb 10), there is a moment when arc is not formed, and this fluctuation is sensed by the eyes as the flickers.

In a case where an electrode rod made of thoriated tungsten is used, the tube voltage is more likely to rise due to a side effect of the thorium oxide contained in the thoriated tungsten so that the restriking voltage also rises in accordance with the rise in tube voltage. Therefore, the flickers are generated in an earlier stage compared to a case where an electrode rod is made of pure tungsten.

In the discharge bulb 10 according to the exemplary embodiment, the first electrode rod 26B is made of thoriated tungsten and the second electrode rod 26A is made of pure tungsten. Therefore, the generation of the flickers in the early stage can be restrained compared to a configuration in which both the electrode rods are made of thoriated tungsten.

Further, by adopting the configuration in which the first electrode rod 26B is made of thoriated tungsten and the second electrode rod 26A is made of pure tungsten, a decrease in luminous flux and a decrease in a generation of noise at the time of turning on the discharge bulb can be restrained compared to the configuration in which both the electrode rods are made of pure tungsten.

The reasons are as follows.

In the electrode rod 26B made of thoriated tungsten, there is a phenomenon in which thorium oxide contained in thoriated tungsten migrates to a surface of the electrode rod 26B, whereby an arc spot 34B (i.e., a luminescent spot) is easily formed (see, e.g., FIG. 2). Thus, a work function at the surface of the electrode rod 26B decreases. More specifically, a minimum energy used to take one electron off from a crystal surface of metal to an immediate outside of the crystal surface decreases, whereby thermoelectron-releasing performance is enhanced. Consequently, heat loss at the electrode rod 26B is saved, and the saved energy is used as an energy for light generation. Accordingly, the decrease in luminous flux can be restrained.

In the electrode rod 26A made of pure tungsten, it takes some time until a size of an arc spot 34A is stabilized after turning on the discharge bulb 10. Thus, noise tends to be generated during that time due to a fluctuation in size of the arc spot 34A. On the other hand, in the electrode rod 26B made of thoriated tungsten, since the arc spot 34B of a certain size is formed in the early stage, the generation of noise when turning on the discharge bulb 10 can be restrained.

As described above, although the discharge bulb 10 according to the exemplary embodiment is configured as a mercury-free discharge bulb, the generation of flickers, the decrease in luminous flux, and the generation of noise when turning on the discharge bulb 10 can be restrained, thereby enhancing overall performance of the discharge bulb 10.

Further, in the discharge bulb 10 according to the exemplary embodiment, the electrode rod 26B is made of thoriated tungsten and the portion thereof exposed into the discharge space 24 has a constant diameter D3, while the electrode rod 26A is made of pure tungsten and the portion thereof exposed to the discharge space 24 includes the base portion 26A1 having a constant diameter D1 and the large-diameter portion 26A2 having a larger diameter D2 than D1 on the distal end side of the base portion 26A1. Thus, the electrode rods 26A, 26B can be visually identified so that it possible to avoid an erroneous assembling.

In addition, although it is more difficult for the arc spot 34A of a certain size is difficult to be formed in the pure tungsten electrode rod 26A than in the thoriated tungsten electrode rod 26B as described above, the pure tungsten electrode rod 26A includes the large-diameter portion 26A2 at the distal end portion thereof. Therefore, a heat capacity of the distal end portion of the electrode rod 26A is increased so that the temperature thereof is decreased, whereby the thermoelectron-releasing performance can be enhanced. Accordingly, it possible to cause the arc spot 34A to reach a certain size relatively early.

Further, according to the exemplary embodiment, the thoriated tungsten electrode rod 26B is disposed to extend from the pinch seal portion 20*b*2 on the rear side of the light generating portion 20*a*, the pure tungsten electrode rod 26A is disposed to extend from the pinch seal portion 20*b*1 on the front side of the light generating portion 20*a*, the diameter D1 of the base portion 26A1 of the electrode rod 26A is smaller than the diameter D3 of the electrode rod 26B, and the diameter D2 of the large-diameter portion 26A2 of the electrode rod 26A is larger than the diameter D3 of the electrode rod 26B. Thus, the following functions and advantages can be obtained.

Namely, in the respective pinch seal portions 20*b*1, 20*b*2 of the arc tube 16, electrode cracks and boundary cracks are formed due to a difference in coefficient of thermal expansion between the electrode rods 26A, 26B and the arc tube body 20 which is made of a silica glass. The electrode cracks extend radially from joint surfaces between the arc tube body 20 and the respective electrode rods 26A, 26B, and the boundary cracks extend in a circumferential direction so as to surround the electrode rods 26A, 26B. In the event that the electrode cracks grow and reach an outer circumferential surface of the arc tube body 20, a leak is generated between the discharge space 24 and an external space thereof (i.e., the cylindrical space between the arc tube 16 and the glass shroud 18). However, the growth of electrode cracks can be prevented by forming the boundary cracks. The boundary cracks are generated on condition that an axial temperature distribution in a portion of the electrode rod 26A, 26B embedded in the pinch seal portion 20*b*1, 20*b*2 is substantially uniform.

When manufacturing the arc tube 16, in a first pinch sealing process in which a pinch sealing is initially performed, it is relatively easy to perform the pinch sealing in such a mode where boundary cracks can be generated. However, in a second pinch sealing process in which a subsequent pinch sealing is performed, there are some limitations on manufacturing conditions, e.g., the pinch sealing needs to be performed while cooling the light generating portion 20*a*. Therefore, it is more difficult to perform the pinch sealing in the mode where the boundary cracks can be generated, compared to the corresponding work in the first pinch sealing process. In addition, the larger the diameters of the electrode rods 26A, 26B are, the more difficult it is for the boundary cracks to be generated.

In this respect, in the exemplary embodiment, the diameter D1 of the base portion 26A1 of the electrode rod 26A disposed in the pinch seal portion 20*b*1 on the front side of the light generating portion 20*a* (i.e., on a side where the second pinch sealing is performed) is smaller than the diameter D3 of the electrode rod 26B disposed in the pinch seal portion 20*b*2 on the rear side of the light generating portion 20*a* (i.e., on a side where the first pinch sealing is performed). Thus, the boundary cracks are more easily generated also in the pinch seal portion 20*b*1 where the second pinch sealing is performed.

Further, the diameter D2 of the large-diameter portion 26A2 of the electrode rod 26A is larger than the diameter D3 of the electrode rod 26B. Thus, although the electrode rod 26A is made of pure tungsten, the temperature of the distal end portion thereof can be decreased, thereby enhancing the thermoelectron-releasing performance. Moreover, when the discharge bulb 10 is used in a vehicle, the temperature of the distal end portion of the electrode rod 26A on the front side of the light generating portion 20*a* becomes lower than that of the other electrode rod 26B. Thus, also in this respect, the temperature at the distal end portion of the pure tungsten electrode rod 26A can be decreased, thereby further enhancing the thermoelectron-releasing performance.

Further, according to the exemplary embodiment, potassium-doped tungsten is used for the pure tungsten electrode rod 26A. Therefore, cost can be reduced compared to a case where tungsten of higher purity is used. In addition, a change in electrode shape with time can be suppressed by doping potassium, whereby the arc spot 34A is formed more stably.

Figure 4:
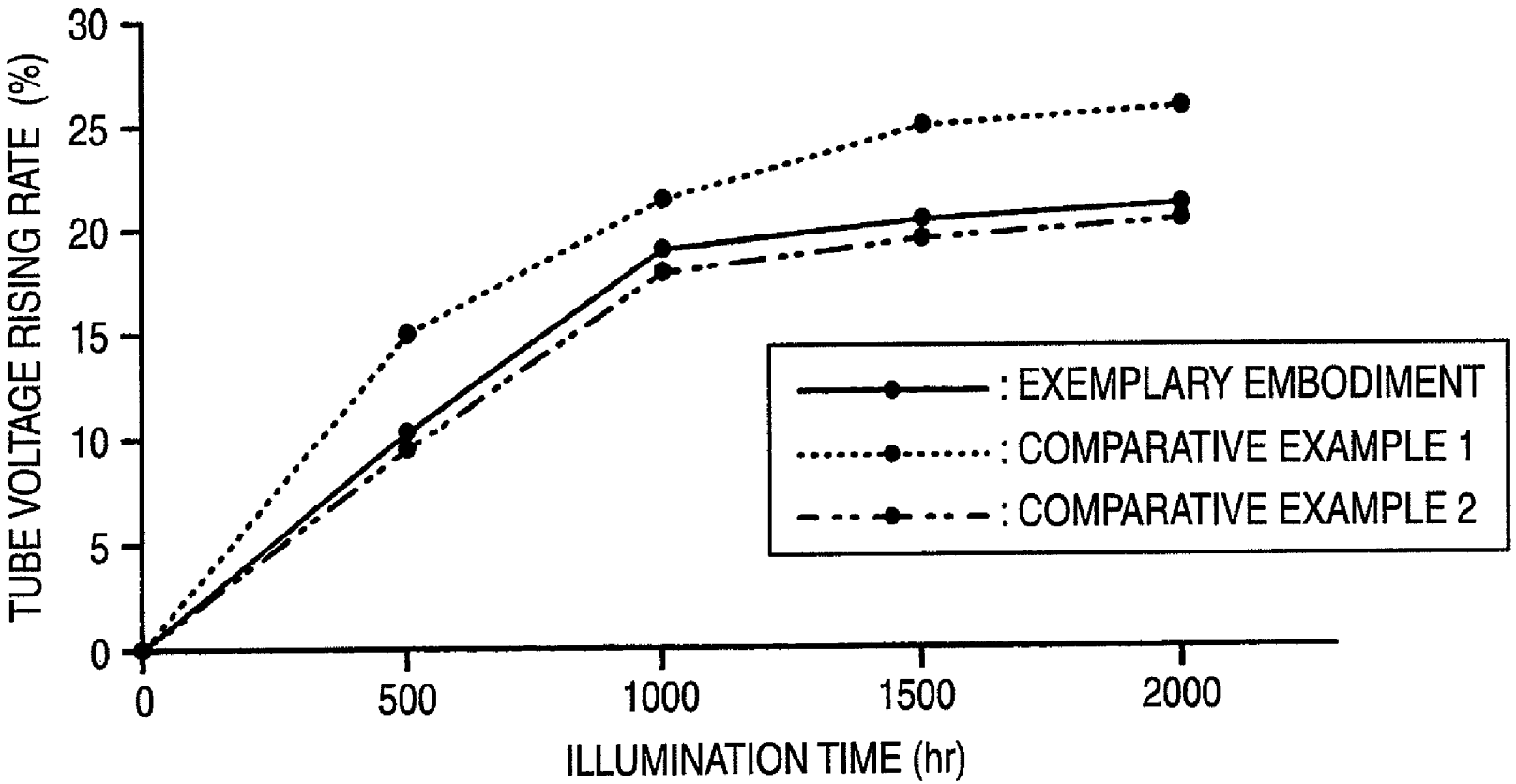
FIG. 4 is a diagram showing a graph comparing the tube voltage rising rates in the vehicle discharge bulb according to the exemplary embodiment and in the comparative example 1 and the comparative example 2.

FIG. 3 is a diagram showing a result of an experiment for verifying bulb performance of the discharge bulb 10 according to the exemplary embodiment in comparison with comparative example 1 and comparative example 2, and FIG. 4 is a diagram showing tube voltage rising rates in the vehicle discharge bulb 10 according to the exemplary embodiment and in the comparative examples 1 and 2.

As shown in FIG. 3, a discharge bulb of the comparative example 1 has electrode rods that are both made of thoriated tungsten, while a discharge bulb of the comparative example 2 has electrode rods that are both made of pure tungsten.

A shape of each of the electrode rods of the comparative examples 1 and 2 is the same as the shape of the electrode rod 26A of the exemplary embodiment. Configurations of the discharge bulbs of the comparative examples 1 and 2 are the same as that of the discharge bulb 10 according to the exemplary embodiment except for the electrode rods.

As shown in FIG. 3, a life of the discharge bulb 10 of the exemplary embodiment is slightly shorter than that of the comparative example 2, but is far longer than that of the comparative example 1.

The luminous flux of the discharge bulb 10 of the exemplary embodiment is slightly smaller than that of the comparative example 1, but is greatly larger than that of the comparative example 2.

The noise generated in the discharge bulb 10 of the exemplary embodiment is slightly worse than that of the comparative example 1, but is largely improved than that of the comparative example 2.

Consequently, when evaluating the life, the luminous flux and the noise comprehensively, the bulb performance obtained by the configuration of the exemplary embodiment is superior to those of the comparative examples 1 and 2.

As shown in FIG. 4, as an illumination time passes, a tube voltage of the discharge bulb rises. However, although a tube voltage rising rate in the discharge bulb 10 of the exemplary embodiment stays slightly higher than that of the comparative example 2, it is far lower than that of the comparative example 1. This is one of the factors contributing to the excellent bulb performance of the exemplary embodiment in comparison with the comparative examples 1 and 2.

While description has been made in connection with an exemplary embodiment of the present invention, those skilled in the art will understand that various changes and modification may be made therein without departing from the present invention. For example, numerical values in the above description of the exemplary embodiment may, of course, be set to different values as is advantageous. It is aimed, therefore, to cover in the appended claims all such changes and modifications falling within the true spirit and scope of the present invention.

What is claimed is:

1. A discharge bulb for a vehicle, comprising:

an arc tube;

a glass shroud cylindrically surrounding the arc tube; and an insulated plug fixedly supporting an end portion of the glass shroud, wherein the arc tube including:

a light generating portion having a discharge space therein;

a first pinch seal portion and a second pinch seal portion, disposed on respective sides of the light generating portion;

a first electrode rod protruding into the discharge space from the first pinch seal portion; and a second electrode rod protruding into the discharge space from the second pinch seal portion so as to be opposed to the first electrode rod, wherein a discharge light-emitting portion is formed directly from the first electrode to the second electrode, wherein the discharge space contains a rare gas and a metal halide, but does not contain mercury, the first electrode is made of thoriated tungsten, and the second electrode rod is made of pure tungsten.

2. The discharge bulb according to claim 1, wherein a diameter of a portion of the first electrode rod exposed into the discharge space is constant, wherein a portion of the second electrode rod exposed into the discharge space comprises:

a base portion; and a large-diameter portion disposed on a distal end side of the base portion, wherein a diameter of the base portion is constant, and a diameter of the large-diameter portion is larger than the diameter of the base portion.

3. The discharge bulb according to claim 2, wherein the diameter of the portion of the first electrode rod exposed into the discharge space is larger than the diameter of the base portion but smaller than the diameter of the large-diameter portion.

4. The discharge bulb according to claim 1, wherein potassium is doped in the pure tungsten.

5. The discharge bulb according to claim 1, wherein the first electrode rod is disposed on a side of the insulated plug.

6. The discharge bulb according to claim 1, wherein end portions of the glass shroud are welded to the arc tube.

7. The discharge bulb according to claim 1, wherein the arc tube further comprises:

a first lead wire extending outward from the first pinch seal portion;

a first metallic foil electrically coupling the first electrode rod and the first lead wire;

a second lead wire extending outward from the second pinch seal portion; and a second metallic foil electrically coupling the second electrode rod and the second lead wire.

8. The discharge bulb according to claim 7, wherein the first lead wire, the first metallic foil, the second lead wire, and the second metallic foil are made of molybdenum.

9. The discharge bulb according to claim 4, wherein an amount of the potassium doped in the pure tungsten is about 100 ppm or less.

10. The discharge bulb according to claim 1, wherein thorium oxide is dispersed in the second electrode rod with a proportion of about 0.8% to about 1.2%.

11. The discharge bulb according to claim 2, wherein an axial length of the large-diameter portion is from about 1 mm to about 2 mm.

12. The discharge bulb according to claim 1, wherein the metal halide comprises sodium iodide and scandium iodide.

13. The discharge bulb according to claim 1, wherein the metal halide comprises at least one of halides of Zn, In, and Sb.

14. The discharge bulb according to claim 1, wherein a tungsten purity of the pure tungsten is about 99.95% or more.

* * * * *